United States Patent [19]

Barouh et al.

[11] Patent Number: 4,710,047

[45] Date of Patent: Dec. 1, 1987

[54] DESK-TOP CORRECTION RIBBON SYSTEM

[76] Inventors: Victor Barouh, 111 Wheatley Rd.; Seth Dinsky, 4 Deepwood Ct., both of Old Westbury, N.Y. 11568

[21] Appl. No.: 754,226

[22] Filed: Jul. 12, 1985

[51] Int. Cl.[4] ..... B41J 29/367

[52] U.S. Cl. ..... 400/697; 400/240.1; 400/242; 400/248

[58] Field of Search ..... 400/208, 240.1, 242, 400/248, 695, 696, 697, 697.1; 132/89, 93

[56] References Cited

U.S. PATENT DOCUMENTS

| | | | |
|---|---|---|---|
| 733,851 | 7/1903 | Koch | 400/248 |
| 797,423 | 8/1905 | Freeman | 132/93 |
| 797,888 | 8/1905 | Follett | 400/208 |
| 1,150,345 | 8/1915 | Dennis | 400/248 X |
| 1,527,845 | 2/1925 | Daniel | 132/89 |
| 3,114,447 | 12/1963 | Wolowitz | 400/240.1 |
| 3,804,227 | 4/1974 | Cappotto et al. | 400/208 |
| 3,807,543 | 4/1974 | Robinson et al. | 400/242 |
| 3,834,512 | 9/1974 | Haugen | 400/697.1 |
| 4,051,943 | 10/1977 | Hanazono et al. | 400/248 X |
| 4,061,220 | 12/1977 | Cho | 400/697 |
| 4,074,799 | 2/1978 | Hishida et al. | 400/208 |
| 4,202,637 | 5/1980 | Tummolo | 400/696 X |

FOREIGN PATENT DOCUMENTS

| | | | |
|---|---|---|---|
| 2547957 | 5/1977 | Fed. Rep. of Germany | 400/697.1 |
| 2528765 | 12/1983 | France | 400/697.1 |
| 0067278 | 6/1981 | Japan | 400/208 |
| 1451316 | 9/1976 | United Kingdom | 400/697.1 |

*Primary Examiner*—Ernest T. Wright, Jr.

*Attorney, Agent, or Firm*—Lackenbach Siegel Marzullo & Aronson

[57] ABSTRACT

A system for positioning correction ribbons having a layer of opaque dry correction material over a letter or image on a surface such as paper for subsequent covering of the image. The system includes a supply spool rotatably mounted in a supply spool holder and a take-up spool rotatably mounted in a take-up spool holder. A hold-down member is adapted to pass the ribbon between the spool holders under the hold-down member in contact with the image. A window is formed by the hold-down member to allow placement of the ribbon and access to the ribbon by a stylus which is rubbed against the ribbon by the user in order to adhere the opaque material to the image.

14 Claims, 14 Drawing Figures

FIG. 1
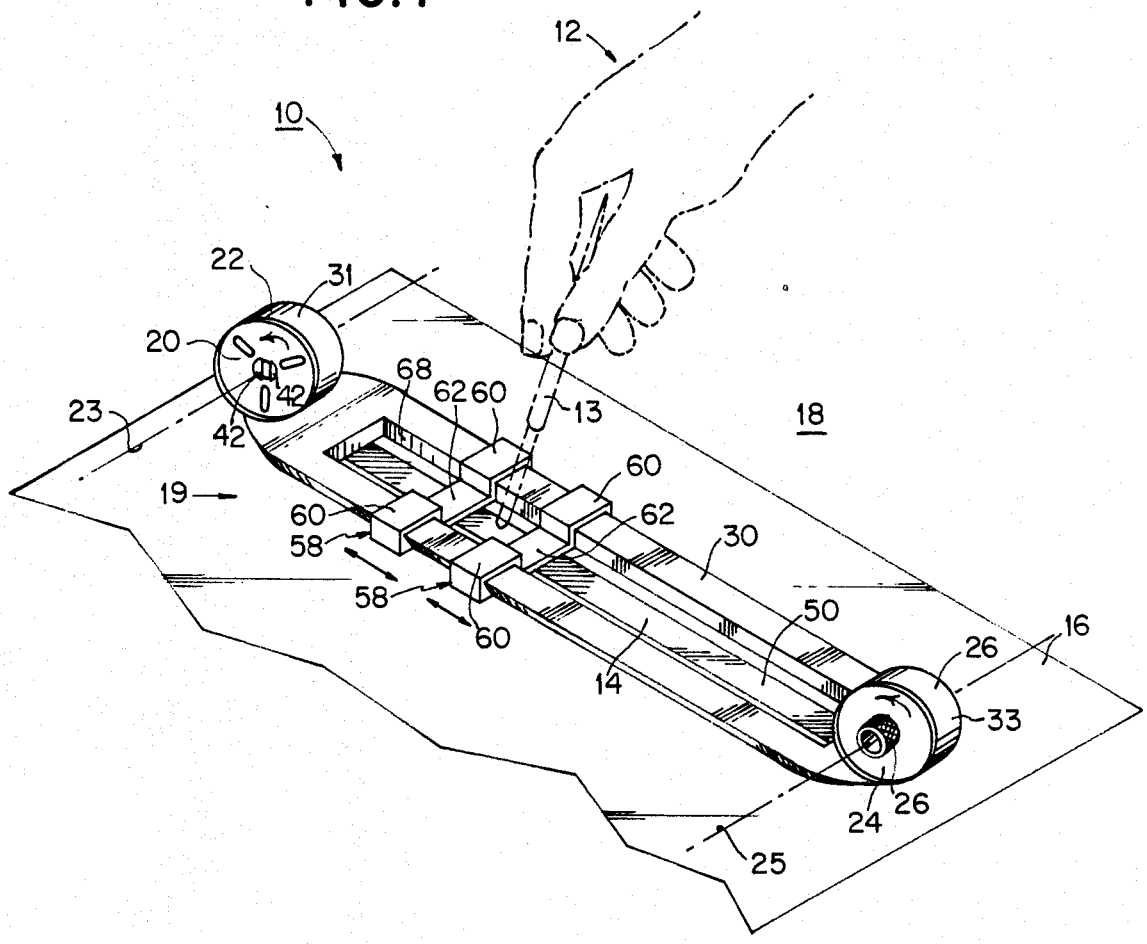
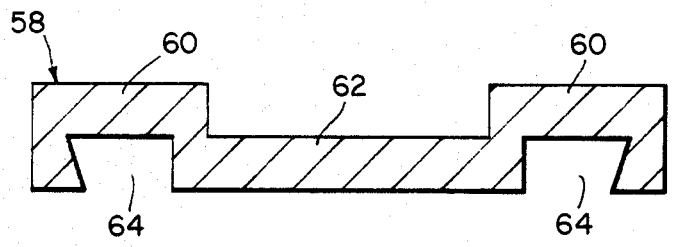
FIG. 14

FIG. 2
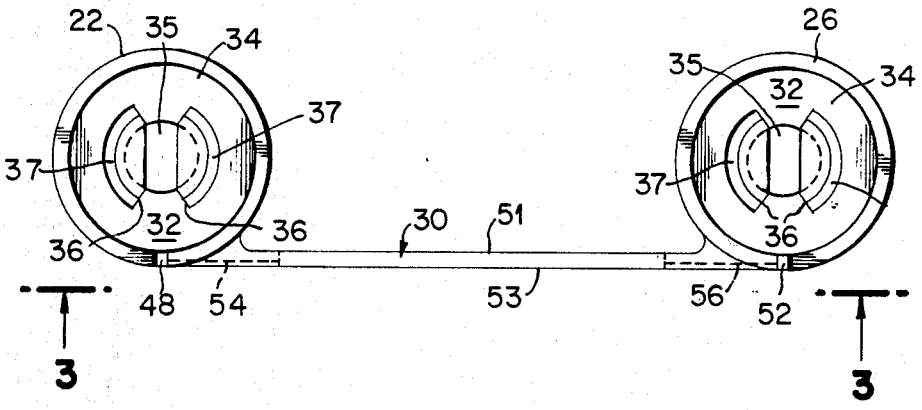
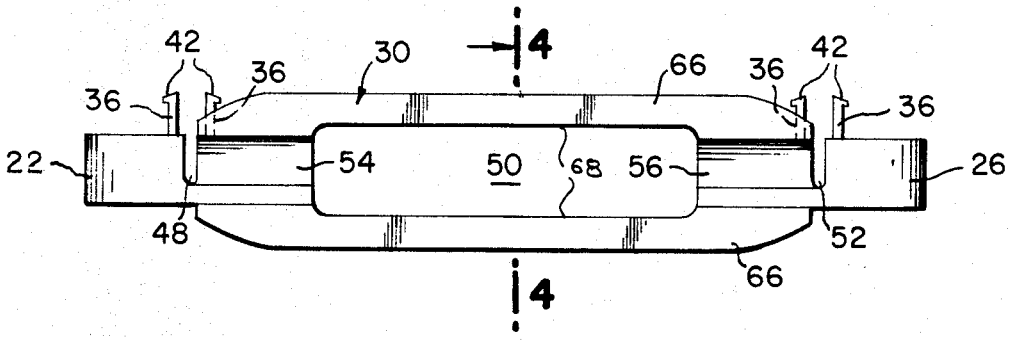
FIG. 3
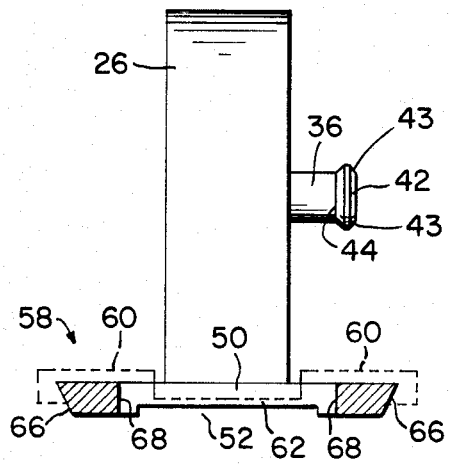
FIG. 4

FIG. 5
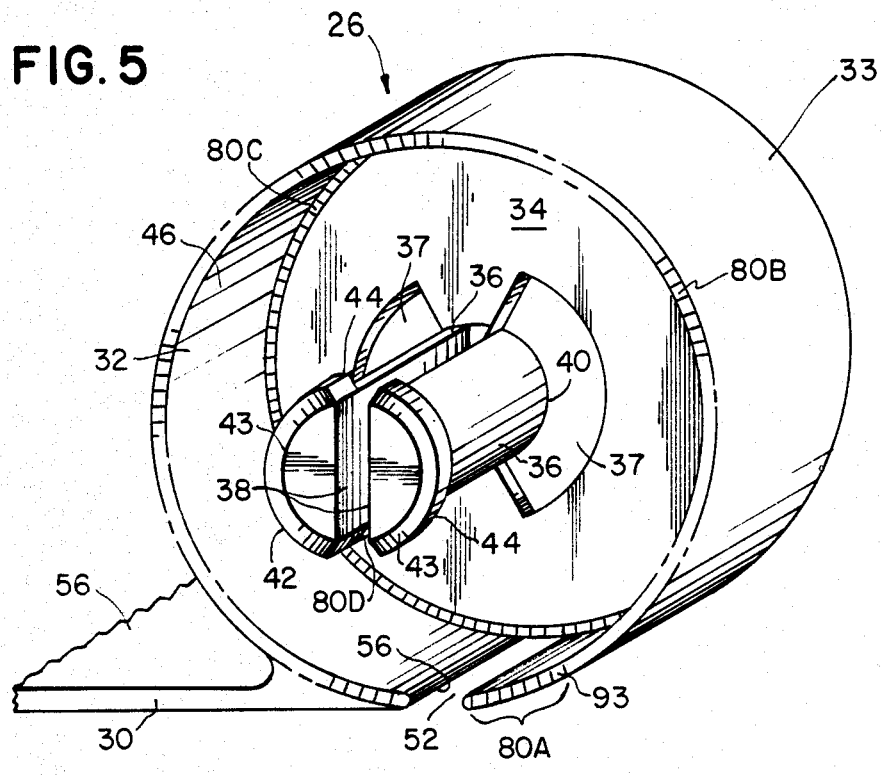
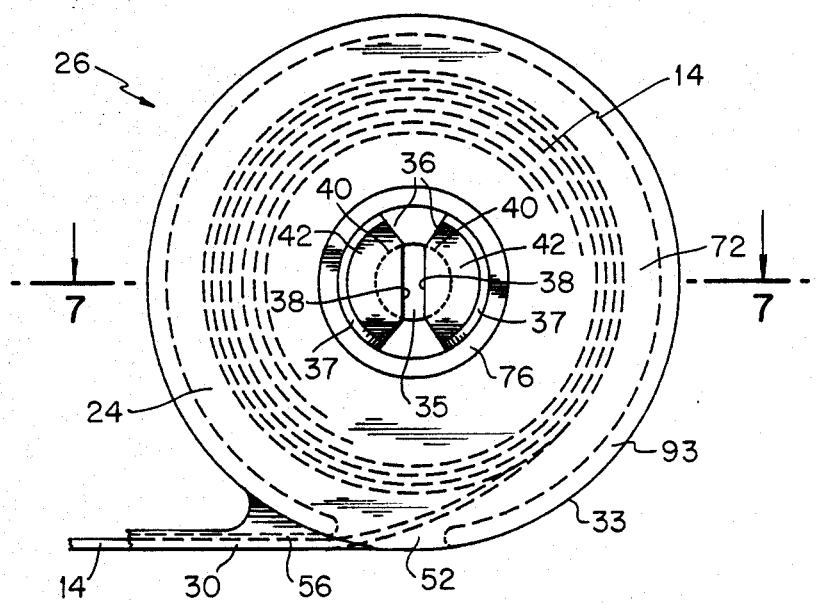
FIG. 6

DESK-TOP CORRECTION RIBBON SYSTEM

BACKGROUND OF THE INVENTION

This invention describes a hand-controlled apparatus for correcting type or ink errors. More particularly, it relates to manually correcting type or ink errors by hand by use of a correction ribbon devoid of any solvent.

Correction fluid for application by hand at a desk top to a sheet of paper with typing or inking errors contains a solvent that quickly dries once the fluid has been applied to cover the error so that only the solid correcting material remains over the error. The solvent, however, can be misused by deliberately concentrating the correction fluid and inhaling the vaporing solvent. This inhaling can be fatal or harmful to the person so abusing the product.

Dry correction ribbon for mounting on typewriters is wellknown, but until recently there has been no reason to adapt such non-solvent correction ribbon to non-typewriter applications since liquid correction fluid has been sufficient to perform such correction tasks.

Dry correction ribbon has several advantages over a liquid correction medium: (a) there is no drying time; (b) there is no interference by solvent with the underlying image; (c) it is safer to use; (d) it does not spill; (e) and there is a much greater economy of use, that is, there is very little waste.

SUMMARY OF THE INVENTION

Accordingly, it is an object of this invention to provide a correction ribbon system that can be used for table top corrections of typed, hand-written, or drawn letters or figures.

It is another object of this invention to provide a system for using a dry medium for making table-top corrections to selected images of manuscripts and drawings.

It is a further object of this invention to provide a hand-held cartridge holder that is adapted to hold a supply ribbon cartridge and a take-up spindle cartridge between an open face wherein the correction ribbon can be hand-rubbed with a stylus upon a selected image to be corrected.

Accordingly, in furtherance of the above objects and others which will become apparent in the course of this disclosure, a system is provided for positioning correction tape or ribbon having a dry correction material over an image to be corrected on a surface for subsequent covering of the image. The system includes a correction ribbon having a removable opaque correction material layer on one side of the ribbon, supply means for holding and advancing an unused amount of the ribbon with the opaque material being aligned downwardly upon release, take-up means spaced from the supply means for receiving a used amount of the ribbon from the supply means, track means connected to the supply means and to the take-up means for holding down the unused amount of the ribbon against the image and providing a passage for the ribbon between the supply means and the take-up means, and access means associated with the track means for aligning the unused amount of the ribbon over the image and for providing access to the unused amount of the ribbon.

The track means is an elongated, flat, hold-down member. The hold-down member has opposed top and bottom sides, the ribbon extending along the bottom side, the ribbon having the opaque correction material layer aligned downwardly. The access means is the hold-down member forming an opening between the top and bottom sides, the ribon being adapted to pass under the opening, the opening being adapted to give a user viewing and pressing access to the upward side of said ribbon.

The hold-down member has a pair of opposed ends, one end being connected to the supply means and the other end being connected to the take-up means. The bottom side of the hold-down member forms a first track recess between the supply means and the opening and a second track recess between the opening and the take-up member, the first and second track recesses being adapted to accept the ribbon wherein the ribbon is not retarded by friction as it is passed under the hold-down member between the supply means and the take-up means.

The supply means includes a first cylindrical holder member including a first cylindrical wall and a first side wall perpendicular to the axis of the first cylindrical wall, the first cylindrical wall and the first side wall defining a first cylindrical chamber, the axis of the first chamber being transverse to the hold-down member, the first chamber having an open side opposite the first side wall. The take-up means includes a second cylindrical holder member including a second cylindrical wall and a second side wall perpendicular to the axis of said second cylindrical call, the second cylindrical wall and the second side wall defining a second cylindrical chamber, the axis of the second chamber being transverse to the hold-down member and parallel to the axis of the first chamber, the second chamber having and open side opposite the second side wall.

The supply means further includes a supply spool member, the supply spool member having a supply spindle and a circular central supply spool outside wall perpendicular to the supply spindle, the unused amount of the ribbon being wound around the supply spindle, the first chamber being adapted to receive the supply spindle with the ribbon, the supply spindle being aligned with the axis of the first chamber, the supply spool wall covering the open wall of the first chamber. The take-up means further includes a take-up spool member, the take-up spool member having a take-up spindle and a circular central take-up spool outside wall perpendicular to the take-up spindle, the used amount of said ribbon being wound around the take-up spindle, the second chamber being adapted to receive the take-up spindle with the ribbon, the take-up spindle being aligned with the axis of the second chamber, the take-up spool wall covering such open wall of the second chamber.

The invention further includes supply spool clip-on means and take-up spool clip-on means for holding the supply spool member and the take-up spool member in the first and second chambers respectively. The take-up spool member includes a cylindrical handle forming a central aperture axially aligned with the take-up spindle. The central aperture is greater than the diameter of the central aperture formed by the take-up spindle, a circular flat surface being formed on the take-up spool wall adjoining the handle and the central aperture for gripping by the clip-on means. The handle is adapted to be gripped by a user so as to rotate the take-up spool member so as to advance, or draw, the ribbon and unwind the ribbon from the supply spool member and cause unused ribbon to be drawn under the hold-down member to a position under the opening. Ratchet means is associated with the take-up spool member and the second holder member for keeping said take-up spool member from being rotated in a reverse direction upon rotation of said take-up spool member by tension of the ribbon in the supply spool member. Pressing means, such as a stylus, is provided for a user to apply pressure to the top of the portion of the ribbon over the image so that the opaque correction material will adhere to the image.

The present invention will be better understood and the main objects and important features will become apparent when consideration is given to the following details and description, which, when taken in conjunction with the annexed drawings, describes, discloses, illustrates, and shows the preferred embodiments or modifications of the present invention and what is presently considered and believed to be the best mode of practice in the principles thereof. Other embodiments or modifications may be suggested to those having the benefit of the teachings herein and such othe embodiments or modifications are intended to be reserved especially as they fall within the scope and spirit of the subjoined claims.

BRIEF DESCRIPTION OF THE DRAWINGS

FIG. 1 is a perspective view of the desk-top ribbon correction system in use;

FIG. 2 is a side elevation of the correction ribbon and spool holder mount;

FIG. 3 is a bottom view of FIG. 2 taken through line 3—3;

FIG. 4 is a sectional view taken through line 4—4 of FIG. 3;

FIG. 5 is a perspective view of the take-up spool holder;

FIG. 6 is a frontal view of the take-up spool holder;

FIG. 14 is an end view of a marking member.

DESCRIPTION OF THE PREFERRED EMBODIMENT

Figure 10:
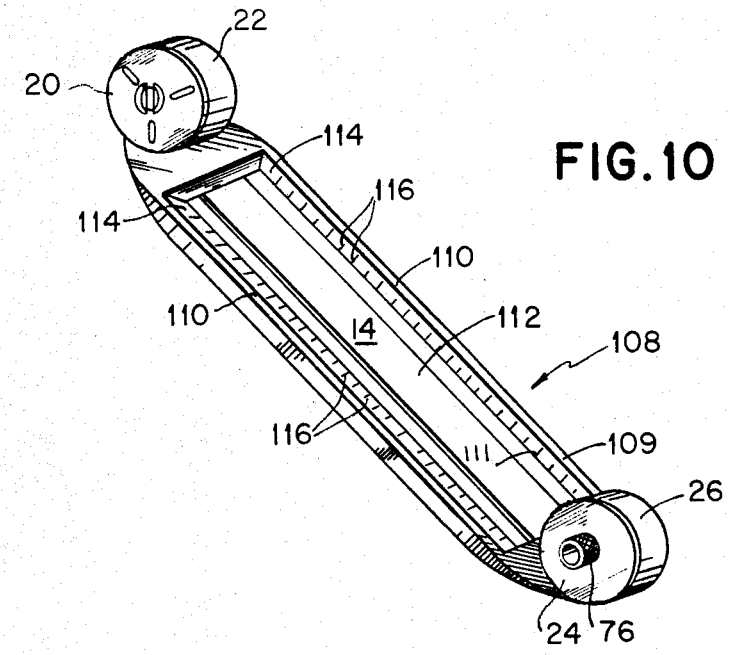
FIG. 10 is a perspective view of an alternate embodiment of the present invention.

Reference is now made specifically to the drawings in which identical or similar parts are designated by the same reference numerals throughout.

A desk-top ribbon correction system 10 is shown in FIG. 1 in a perspective view with the hand 12 of a user holding a pressing stylus 13 against the top of a correction ribbon 14 mounted on a transportable ribbon holder 19 stretched over an image (not shown) to be corrected on a piece of paper 16 lying placed upon a desk top 18. Holder 19, in turn, includes a supply spool 20 positioned in a supply spool holder 22; a take-up spool 24 positioned in a take-up spool holder 26 spaced from supply spool 20; and an elongated ribbon track member 30 that is attached at each of its elongated ends to the bottoms of supply spool holder 22 and take-up spool holder 26. Holders 22 and 26 are cylindrical in configuration having parallel axes 23 and 25, respectively, equally spaced above ribbon hold-down track member 30, and each having open sides located on the same side of track member 30.

Figure 7:
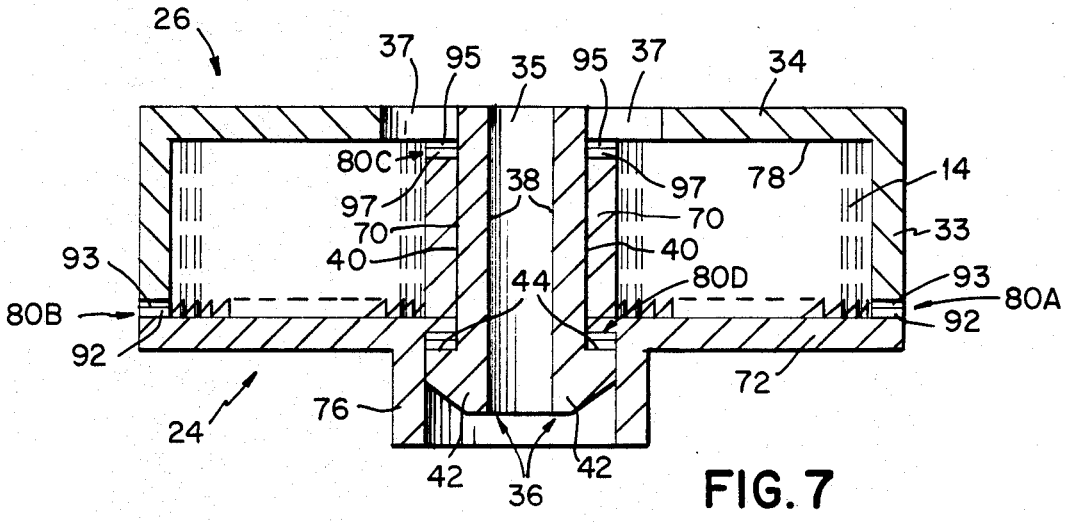
FIG. 7 is a view taken through line 7—7 of FIG. 6.

FIGS. 2, 3, and 4 are side, bottom, and cross-sectional views of ribbon track member 30 in isolation devoid of supply and take-up spools 20 and 24 and correcting ribbon 14. Supply and take-up spool holders 22 and 26 include cylindrical outer walls 31 and 33, respectively that each form a cylindrical chamber 32 adapted to hold supply spools 20 and 24 respectively. FIG. 5 shows take-up spool holder 26, by way of example, with supply spool holder 22 being the same as holder 26 mutatis mutandis the holders 22 and 26 being mirror images of one another, as is seen in FIG. 7. Holders 22 and 26 have a circular vertical rear wall 34 forming a center hole 35 and a pair of arced holes 37 horizontally positioned on both sides of the center hole 35; both the center hole 35 and the arced holes 37 are formed for casting process convenience. A pair of parallel, horizontally extending biasable clip members 36 are connected to rear wall 34 and extend outwardly from wall areas equally spaced on either side from the axis line 25 of cylindrcal holder 26. Clip members 36 have a vertical flat, facing inner surfaces 38 and partly circular outwardly facing surfaces 40 opposite inner surfaces 38. A pair of detent elements 42 extend horizontally outwardly from the outer ends of clip members 36; detent elements 42 include outward tapers 43 at their outer edges. Locking recesses 44 are formed between the inner sides of detent elements 42 and clip members 36. Clip members 36 are adapted to be moved from their normaly unbiased modes of parallel relationship to biased modes wherein detent elements 42 are moved towards one another to a position closely spaced from one another. Clip members 36 with detent elements 42 extend beyond the vertical planes of the open sides 46 of holders 22 and 26 opposite rear walls 34 as seen in FIGS. 3 and 4.

As seen in FIGS. 1–4, supply spool holder 22 and take-up spool holder 26 are connected at their botton sides to the opposed ends of track member 30 with supply spool 20 and take-up spool 24 being rotatably positioned in holders 22 and 26. Ribbon 14 is extended from supply spool 20 through a guide slot 48 formed across the bottom of supply spool holder 22 transverse to ribbon 14, then under track member 30, particularly under the center of an elongated window 50 formed by track member 30 between top and bottom sides 51 and 53, respectively, of track member 30 to another guide slot 52 formed across the bottom of take-up spool holder 26 and onto take-up spool 24.

Ribbon 14 can be viewed the entire length of track member 30. As best seen in FIGS. 3 and 4, track recesses 54 and 56 are formed by track member 30 at its bottom side between supply spool holder 22 and one end of window 50 and the opposed end of window 30 and take-up spool holder 26; track recesses 54 and 56 are adapted to hold and guide ribbon 14 in its travel between spools 20 and 24.

As best seen in FIG. 1, in phantom line in FIG. 4, and in single representation in end view in FIG. 14, the embodiment of the invention being discussed preferably includes a pair of marking members 58 slidably mounted over track member 30 and window 50. Each marking member 58 includes spaced, horizontal, flat sides portions 60 and a flat middle portion 62 that is connected to side portions 60. Side portions 60 each for inwardly tapered parallel grooves 64 that are adapted to be fitted over and ride upon elongated, parallel, inwardly tapered side elements 66 of track member 30, side elements 66 being adapted to act as rails for marking member 58 in the embodiment being discussed. Elements 66 framing window 50 have opposed inner vertical side walls 68. Middle portion 62 is positioned lower than side portions 60 so as to ride within window opening 50 between side walls 68. Marking members 58 are made of transparent plastic material and are biasable so that each is in gripping, biased relationship with track member 30.

In operation, track member 30 is set laterally across the image or letter to be corrected and marking members 58 are slidably positioned so as to isolate the area to be corrected whereupon stylus 13 is employed in a manner to be explained.

Figure 8:
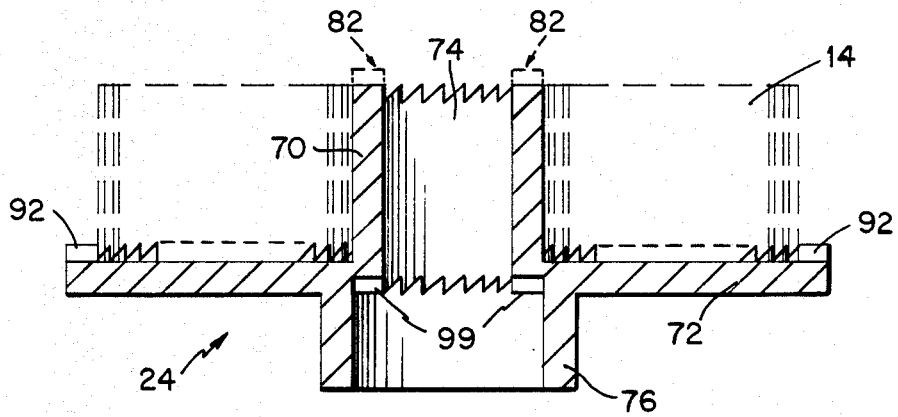
FIG. 8 is a sectional view of the take-up spool.

Spools 20 and 24 are shown rotatably mounted into holders 22 and 26, respectively, in FIG. 1 and take-up spool 24 is shown mounted into holder 26 in FIG. 6 and in cross-section in FIG. 7. Take-up spool 24 is also shown in isolated cross-section in FIG. 8. As will be set forth in detail below, take-up spool 24 is adapted to be rotated so as to draw, or advance, ribbon 14 from supply spool 20, which at the same time is rotated as it gives up unused ribbon 14. Take-up spool 24 includes a cylindrical spindle 70 and a circular side wall 72 axially mounted at the outside end of spindle 70; side wall 72 is located across open side 46 of holder 26. Spindle 70 forms a cylindrical axial aperture 74 that opens at both the inner and outer ends of the aperture 74. Ribbon 14 is shown in full take-up mode around spindle 70 in phantom lines in FIG. 7 and 8 for purposes of exposition. A cylindrical handle 76 forming a cylindrical hollow is axially positioned with and connected to side wall 72. Handle 76 is greater in diameter than aperture 74 so that a circular grip area at the outer surface of outer side wall 72 remains. The length of spindle 70 is the same as the length of each clip member 36 measured from the inner surface 78 of rear wall 34 measured from its inner surface 78 and the flat vertical surfaces of detent elements 42 that face inner surface 78. Detent elements 42 are biased inwardly into aperture 74 by the inner cylindrical walls of spindle 70 during the mounting of spool 26 around clip members 36, then return to their biased mode and grip spool 24 at the circular grip area at the outer surface of outer side wall 72. Detent elements 42 are pressed towards one another in particular as spindle 70 presses against inwardly tapered surfaces 43 of detent elements 42 during insertion into holder 26.

The ends of clips 36 snap outwardly from biased modes to unbiased modes as locking recesses 44 pass the outer surfaces of outer side wall 72 over the circular grip area of outer side wall 72 so as to grip spool 24 within holder 26. Outer side wall 72 extends to the outer surface of cylindrical wall 33. The outer surface of cylindrical handle 76 is preferably knurled as seen in FIG. 1.

Figure 9:
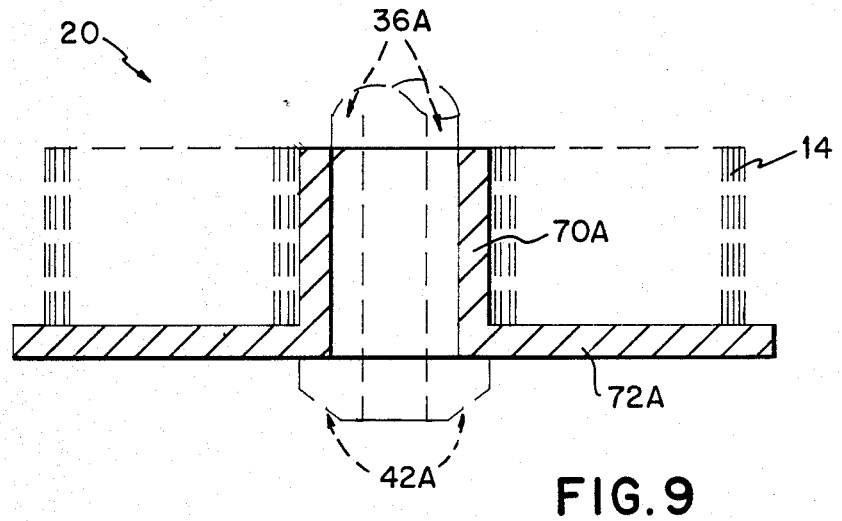
FIG. 9 is a sectional view of the supply spool, with the hold-on clip shown in phantom line.

Supply spool 20 is seen in cross-section in FIG. 9 in a view analogous to the take-up spool 24 in FIG. 7 with clips 36 shown in phantom as clips 36A and detent elements as 42A. Supply spool 20 includes a spindle 70A and an outer side wall 72A each analogous to spindle 70 and side wall 72 of take-up spool 24. Because supply spool 20 does not have to be rotated, supply spool 20 is devoid of a handle. Detent elements 42A can grip the outer surface of outer wall 72A in the same manner as detent elements 42 grip outer wall 72 of spool 20. Outer wall 72A extends to the outer surface of outer wall 31 of holder 22, which is analogous to outer wall 33 of holder 26. Unused ribbon 14 is shown in full around supply spindle 72A in FIG. 9 for purposes of exposition.

Figure 11:
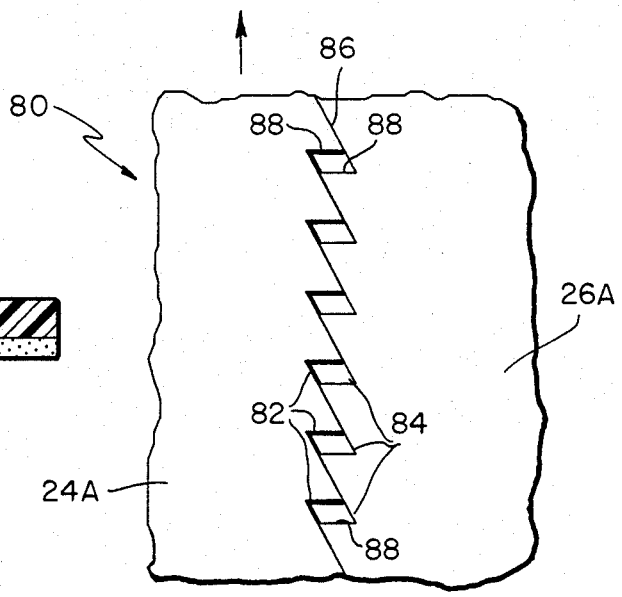
FIG. 11 is a side view fragment of a typical ratchet engagement between the take-up spool and the take-up spool holder.

After take-up spool 24 has been rotated via handle 76 so as to draw a used amount of ribbon 14 onto spindle 70, there will be a tendency for supply spool 20 to resist the rotation so that a reactive tension tends to educe a slight reverse rotation of take-up spool 24. To counteract this reversing tendency, ratchet interactions are preferably provided between selected locations of take-up spool 24 and take-up spool holder 26. FIG. 11 illustrates a fragment of a typical ratchet 80, which is suitable for any of ratchets 80A, 80B, 80C, and 80D, all of which are discussed in detail below with a portion 24A of take-up spool 24 shown on the left side of the drawing being rotated upwardly relative a stationary portion 26A of take-up holder 26. A plurality of interlocking first and second grooves 82 and 84, respectively, are formed by portions 24A and 26A, respectively. First and second grooves 82 and 84 can also be said to form teeth. Grooves 82 will interlock with grooves 84, when spool portion 24A is motionless and slide out of interlock along tapers 85 upon movement of spool portion 24A. When spool portion 24A ceases to rotate, grooves 82 fall back into interlock with grooves 84. As seen in FIG. 11, grooves 82 and 84 preferably form mutually transverse surfaces 88 so that when grooves 82 interlock with grooves 84, transverse surface 88 of holder portion 26A effectively blocks reverse rotation of spool portion 24A.

As noted earlier, spindler 70 is kept in pressing contact to locking recesses 44 so that the inner surface 92 of the outer rim of side wall 72 of take-up spool 24 presses against the flat outer rim surface 93 of cylindrical wall 33 of take-up spool holder 26 and grooves 82 and 84 are kept in pressing contact. In a first embodiment of the ratchet, designated as ratchet 80A, a portion of inner surface 92 of take-up spool 24 and the entire outer rim surface 93 of take-up holder 26 are provided with ratchet grooves, as seen in FIG. 7. In a second ratchet embodiment, shown as ratchet 80B in FIG. 7, the entire inner rim surface 92 can alternatively be provided with a ratchet. A third ratchet embodiment 80C is shown positioned between the inner rim surface 95 of side wall 34 of take-up holder 26 and the inner flat rim 97 of take-up spindle 70. A fourth ratchet embodiment 80D is shown positioned at locking recesses 44 of detent elements 42 of take-up holder 26 and the flat outer surface 99 of the inner rim of wall 72 of take-up spool 24. At such ratchet areas 80A, 80B, 80C and 80D, the surfaces between holder 26 and spool 24 are in pressing contact.

Figure 13:
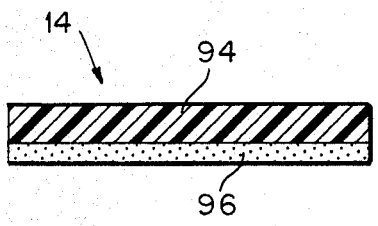
FIG. 13 is a cross-sectional view of a correcting ribbon.

FIG. 13 shows a transverse cross-section of the preferred correction ribbon 14, which includes a top layer 94 and a bottom layer 96 which is a dry, opaque, removable correction material capable of being pressed, or rubbed, from top layer 94 into adhering contact with an image to be corrected.

Figure 12:
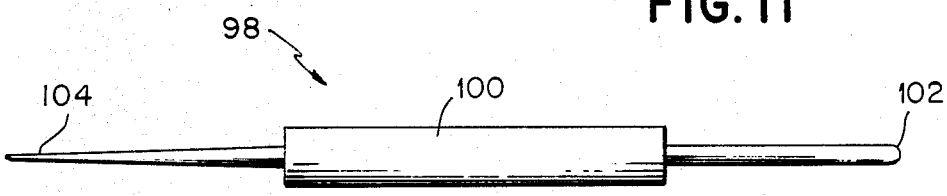
FIG. 12 is a view of the pressing stylus.

FIG. 12 illustrates a stylus 98 having opposed end portions 102 and 104 and a gripping portion 100 between end portions 102 and 104. Both end portions 102 and 104 preferably having pressing-down elements. Stylus 98 can be plastic or metal. In particular, one end portion is a full round end 102 and the other end portion is a tapered ball end 104.

System 10, including spools 20 and 24, holders 24 and 26, and hold-down member 30, is preferably made of a plastic material. The entire system is preferably adapted to be discarded once ribbon 14 has been used.

FIG. 10 shows an alternative embodiment of the invention to marking members 58 to enable a user to be able to limit the area of the applciation of stylus 13.

A ribbon track member 108 includes elongated, parallel, side elements 110, which are analogous to side elements 66 of Figures 1–9, and which define the length of opening 112, and form opposed inward tapers 114 beween the top and bottom sides 109 and 111, respectively, of track member 108. A plurality of measuring marks, or lines 116 are positioned on tapers 114 so as to guide the application of stylus 13. Supply and take-up spool holders 22 and 26 and supply and take-up spools 20 and 24 are the same as for the embodiment of FIGS. 1–9.

Although the present invention has been described in some detail by way of illustration and example for purposes of clarity of understanding, it will of course be understood that various changes and modifications may be made in the form, detail, and arrangements of the parts without departing from the scope of the invention as set forth in the following claims.

What is claimed is:

1. A system for positioning a correction ribbon having a dry correction material over an image on a surface for subsequent covering of said image, comprising, in combination, a correction ribbon having a removable opaque correction material layer on one side of said ribbon, supply means for holding and advanceably releasing an unused amount of said ribbon with said opaque material being aligned downwardly upon release, said supply means including a first cylindrical holder including a first cylindrical wall having a first axis and a first rear wall perpendicular to said first axis, said first rear wall and said first cylindrical wall defining a first cylindrical chamber, said supply means further including a supply spool member having a supply spindle and a circular supply spool outside wall perpendicular to said supply spindle, said unused amount of said ribbon being wound around said supply spindle, said first cylindrical chamber having a first open side opposite said first rear wall and being capable of receiving said supply spindle with said ribbon, said supply spindle being aligned with said first axis, said supply spool outside wall covering said first open side, take-up means spaced from said supply means for receiving a used amount of said ribbon from said supply means, said take-up means including a second cylindrical holder including a second cylindrical wall having a second axis parallel to said first axis and a second rear wall perpendicular to said second axis, said second rear wall and said second cylindrical wall defining a second cylindrical chamber, said take-up means further including a take-up spool member having a take-up spindle and a circular take-up spool outside wall perpendicular to said take-up spindle, said used amount of said ribbon being wound around said take-up spindle, said second cylindrical chamber having a second open side opposite said second rear wall, said second cylindrical chamber being capable of receiving said take-up spindle with said ribbon, said take-up spindle being aligned with said second axis, said take-up spool outside wall covering said second open side, track means connected to said supply means and said take-up means for holding down said unused amount of said ribbon against said image and providing a passage for said ribbon between said supply means and said take-up means, said first and second axes being transverse to said track means, access means associated with said track means for aligning a portion of said unused ribbon over said image and for providing access to said ribbon, and supply spool clip-on means and take-up spool clip-on means for holding said supply spool member and said take-up spool member in said first and second cylindrical chambers, respectively, said supply spool clip-on means and said take-up spool clip-on means including a first and second pair of biasable parallel elongated members, respectively, said elongated members having inner ends connected to said first and second rear walls of said first and second cylindrical holders spaced from said first and second axes and opposed outer ends spaced outwardly from said open sides of said first and secoond cylindrical chambers, said pair of elongated members further including a first pair of detent elements positioned at said outer ends, capable of being moved from normally unbiased modes of parallel relationship to biased modes wherein said first pair of detent elements move toward one another to a position closely spaced from one another, said elongated members having inner ends connected to said first and second rear walls of said first and second cylindrical holders spaced from said first and second axes and opposed outer ends spaced outwardly from said open sides of said first and second cylindrical chambers, said pair of elongated members further including a second pair of detent elements positioned at said outer ends, each said second pair of detent elements having an outer edge and having an outward taper at said outer edge, each said second pair of detent elements having a flat inner side facing said first and second rear walls, each said flat inner side and each said biasable elongated member forming a locking recess, said supply and take-up spool outside walls each having an inner rim with a circular flat outer surface said flat inner side of said second pair of detent elements being in pressing contact with said circular flat outer surface at said locking recess, said supply spindle and said take-up spindle forming first and second cylindrical apertures, respectively, having first and second cylindrical inner surfaces, said first and second cylindrical apertures being capable of receiving said first and second pairs of detent elements in said biased mode during mounting of said supply and take-up spindles onto said first and second pairs of detent elemnts, said first and second inner surfaces riding along said outward tapers during the mounting process, said first and second pairs of biasable elongated members returning to the unbiased mode when said supply spool and said take-up spool outer walls become locked at said flat inner sides of said locking recesses, ratchet means associated with said take-up spool member and said second cylindrical holder for keeping said take-up spool member from being rotated in a reverse direction upon rotation of said take-up spool member, said second cylindrical wall having a flat rim surface at said second open side aligned perpendicular to said second axis, said ratchet means including said take-up spool outside wall having an inner surface rim in pressing contact with said flat rim surface, said flat rim surface having at least a portion of said flat rim surface forming first grooves, and said inner surface rim forming second grooves being capable of interlocking with said first grooves and preventing reverse rotation upon cessation of rotation of said take-up spool member.

2. The system according to claim 1, wherein said at least a portion of said flat rim surface is the entire flat rim surface and said first grooves extend around said entire flat rim surface and said second grooves extend around the entire inner surface rim of said take-up spool outside wall.

3. The system according to claim 1, further including pressing means for a user to apply pressure to the top of said portion of said unused amount of said ribbon over said image so that said opaque correction material will adhere to said image.

4. The system according to claim 3, wherein said pressing means is a stylus having opposed end portions and a gripping portion between said end portions, at least one of said end portions forming a first pressing portion.

5. The system according to claim 4, wherein said first pressing portion has a full round configuration.

6. The system of claim 5, wherein said at least one of said end portions includes the other of said end portions forming a second pressing portion, said second pressing portion being a tapered ball configuration.

7. The system according to claim 3, further including marking means associated with said track means for guiding the user during operation of said pressing means.

8. The system according to claim 7, wherein said track means includes an elongated hold-down member having opposed top and bottom sides, and ribbon extending along said bottom side, said ribbon having said opaque correction material aligned downwardly, wherein said access means includes said hold-down member forming an opening between said top and bottom sides, said ribbon passing under said opening, said opening giving a user viewing and pressing access to said ribbon, and wherein said marking means includes said hold-down member having a pair of spaced, elongated, parallel side elements defining the length of said opening, and further includes a pair of marking members each slidably mounted with said pair of side elements and each individually movable over said opening, whereby said marking members define a designated area in which a correction is to be made.

9. The system according to claim 7, wherein said marking means includes a hold-down member having a pair of spaced, elongated, parallel, side elements defining the length of an opening with top and bottom sides at least one of said side elements forming an elongated inward taper between said top and bottom sides, and further including a plurality of measuring marks, whereby the user is able to limit the area of the application of the pressing means.

10. The system according to claim 1, wherein said ribbon has a top and bottom layer, said bottom layer being a dry, opaque removable correcting material capable of adhering to said image, and said top layer being transparent.

11. The system according to claim 1, wherein said supply means, said take-up means, and said track means are made of a plastic material.

12. The system according to claim 1, wherein said take-up spool member further includes a cylindrical handle forming a central aperture axially aligned with said second cylindrical aperture of said take-up spindle, said central aperture being greater in diameter than said second cylindrical aperture with said circular flat surface of said take-up spindle being located between said handle and said circular flat outer surface of said take-up spindle, said handle being gripped by a user so as to rotate said take-up spindle so as to advance said ribbon and unwind said ribbon from said supply spindle and cause said ribbon to be drawn under said track means.

13. A system for positioning a correction ribbon having a dry correction material over an image on a surface for subsequent covering of said image, comprising, in combination, a correction ribbon having a removable opaque correction material layer on one side of said ribbon, supply means for holding and advanceably releasing an unused amount of said ribobn with said opaque material being aligned downwardly upon release, said supply means including a first cylindrical holder including a first cylindrical wall having a first axis and a first rear wall perpendicular to said first axis, said first rear wall and said first cylindrical wall defining a first cylindrial chamber, said supply means further including a supply spool member having a supply spindle and a circular supply spool outside wall perpendicular to said supply spindle, said unused amount of said ribbon being wound around said supply spindle, said first cylindrical chamber having a first open side opposite said first rear wall and being capable of receiving said supply spindle with said ribbon, said supply spindle being aligned with said first axis, said supply spool outside wall covering said first open side, take-up means spaced from said supply means for receiving a used amount of said ribbon from said supply means, said take-up means including a second cylindrical holder including a second cylindrical wall having a second axis parallel to said first axis and a second rear wall perpendicular to said second axis, said second rear wall and said second cylindrical wall defining a second cylindrical chamber, said take-up means further including a take-up spool member having a take-up spindle and a circular take-up spool outside wall perpendicular to said take-up spindle, said used amount of said ribbon being wound around said take-up spindle, said second cylindrical chamber having a second open side opposite said second rear wall, said second cylindrical chamber being capable of receiving said take-up spindle with said ribbon, said take-up spindle being aligned with said second axis, said take-up spool outside wall covering said second open side, track means connected to said supply means and said take-up means for holding down said unused amount of said ribbon against said image and providing a passage for said ribbon between said supply means and said take-up means, said first and second axes being transverse to said track means, access means associated with said track means for aligning a portion of said unused ribbon over said image and for providing access to said ribbon, and supply spool clip-on means and take-up spool clip-on means for holding said supply spool member and said take-up spool member in said first and second cylindrical chambers, respectively, said supply spool clip-on means and said take-up spool clip-on means including a first and second pair of biasable parallel elongated members, respectively, said elongated members having inner ends connected to said first and second rear walls of said first and second cylindrical holders spaced from said first and second axes and opposed outer ends spaced outwardly from said open sides of said first and second cylindrical chambers, said pair of elongated members further including a first pair of detent elements positioned at said outer ends, capable of being moved from normally unbiased modes of parallel relationship to biased modes wherein said first pair of detent elements move toward one another to a position closely spaced from one another, said elongated members having inner ends connected to said first and second rear walls of said first and second cylindrical holders spaced from said first and second axes and opposed outer ends spaced outwardly from said open sides of said first and second cylindrical chambers, said pair of elongated members further including a second pair of detent elements positioned at said outer ends, each said second pair of detent elements having an outer edge and having an outward taper at said outer edge, each said second pair of detent elements having a flat inner side facing said first and second rear walls, each said flat inner side and each said biasable elongated member forming a locking recess, said supply and take-up spool outside walls each having an inner rim with a circular flat outer surface, said flat inner side of said second pair of detent elements being in pressing contact with said circular flat outer surface at said locking recess, said supply spindle and said take-up spindle forming first and second cylindrical apertures, respectively, having first and second cylindrical inner surfaces, said first and second cylindrical apertures being capable of receiving said first and second pairs of detent elements in said biased mode during mounting of said supply and take-up spindles onto said first and second pairs of detent elements, said first and second inner surfaces riding along said outward tapers during the mounting process, said first and second pairs of biasable elongated members returning to the unbiased mode when said supply spool and said take-up spool outer walls become locked at said flat inner sides of said locking recesses, ratchet means associated with said take-up spool member and said second cylindrical holder for keeping said take-up spool member from being rotated in a reverse direction upon rotation of said take-up spool member, said second rear wall of said second cylindrical holder having an inner surface rim and said take-up spindle of said take-up spool member having an inner flat rim in pressing contact with said inner surface rim side wall, said ratchet means including said inner surface rim and said inner flat rim forming first and second grooves, respectively, capable of interlocking and preventing reverse rotation upon cessation of rotation of said take-up spool member.

14. A system for positioning a correction ribbon having a dry correction material over an image on a surface for subsequent covering of said image, comprising, in combination, a correction ribbon having a removable opaque correction material layer on one side of said ribbon, supply means for holding and advanceably releasing an unused amount of said ribbon with said opaque material being aligned downwardly upon release, said supply means including a first cylindrical holder including a first cylindrical wall having a first axis and a first rear wall perpendicular to said first axis, said first rear wall and said first cylindrical wall defining a first cylindrical chamber, said supply means further including a supply spool member having a supply spindle and a circular supply spool outside wall perpendicular to said supply spindle, said unused amount of said ribbon being wound around said supply spindle, said first cylindrical chamber having a first open side opposite said first rear wall and being capable of receiving said supply spindle with said ribbon, said supply spindle being aligned with said first axis, said supply spool outside wall covering said first open side, take-up means spaced from said supply means for receiving a used amount of said ribbon from said supply means, said take-up means including a second cylindrical holder including a second cylindrical wall having a second axis parallel to said first axis and a second rear wall perpendicular to said second axis, said second rear wall and said second cylindrical wall defining a second cylindrical chamber, said take-up means further including a take-up spool member having a take-up spindle and a circular take-up spool outside wall perpendicular to said take-up spindle, said used amount of said ribbon being wound around said take-up spindle, said second cylindrical chamber having a second open side opposite said second rear wall, said second cylindrical chamber being capable of receiving said take-up spindle with said ribbon, said take-up spindle being aligned with said second axis, said take-up spool outside wall covering said second open side, track means connected to said supply means and said take-up means for holding down said unused amount of said ribbon against said image and providing a passage for said ribbon between said supply means and said take-up means, said first and second axes being transverse to said track means, access means associated with said track means for aligning a portion of said unused ribbon over said image and for providing access to said ribbon, and supply spool clip-on means and take-up spool clip-on means for holding said supply spool member and said take-up spool member in said first and second cylindrical chambers, respectively, said supply spool clip-on means and said take-up spool clip-on means including a first and second pair of biasable parallel elongated members, respectively, said elongated members having inner ends connected to said first and second rear walls of said first and second cylindrical holders spaced from said first and second axes and opposed outer ends spaced outwardly from said open sides of said first and second cylindrical chambers, said pair of elongated members further including a first pair of detent elements positioned at said outer ends, capable of being moved from normally unbiased modes of parallel relationship to biased modes wherein said first pair of detent elements move toward one another to a position closely spaced from one another, said elongated members having inner ends connected to said first and second rear walls of said first and second cylindrical holders spaced from said first and second axes and opposed outer ends spaced outwardly from said open sides of said first and second cylindrical chambers, said pair of elongated members further including a second pair of detent elements positioned at said outer ends, each said second pair of detent elements having an outer edge and having an outward taper at said outer edge, each said second pair of detent elements having a flat inner side facing said first and second rear walls, each said flat inner side and each said biasable elongated member forming a locking recess, said supply and take-up spool outside walls each having an inner rim with a circular flat outer surface, said flat inner side of said second pair of detent elements being in pressing contact with said circular flat outer surface at said locking recess, said supply spindle and said take-up spindle forming first and second cylindrical apertures, respectively, having first and second cylindrical inner surfaces, said first and second cylindrical apertures being capable of receiving said first and second pairs of detent elements in said biased mode during mounting of said supply and take-up spindles onto said first and second pairs of detent elements, said first and second inner surfaces riding along said outward tapers during the mounting process, said first and second pairs of biasable elongated members returning to the unbiased mode when said supply spool and said take-up spool outer walls become locked at said flat inner sides of said locking recesses, ratchet means associated with said take-up spool member and said second cylindrical holder for keeping said take-up spool member from being rotated in a reverse direction upon rotation of said take-up spool member, said ratchet means including said circular flat outer surface of said take-up spool outside wall forming first grooves and said second pair of detent elements each having inner surfaces in pressing contact with said circular flat outer surface, said inner surfaces forming second grooves being capable of interlocking with said first grooves and preventing reverse rotation upon cessation of rotation of said take-up spool member.

* * * * *